US007191830B2

(12) United States Patent
McVay et al.

(10) Patent No.: US 7,191,830 B2
(45) Date of Patent: Mar. 20, 2007

(54) ANNULAR PRESSURE RELIEF COLLAR

(75) Inventors: Chester S. McVay, Carrollton, TX (US); Ronald E. Sweatman, Montgomery, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 90 days.

(21) Appl. No.: 10/789,631

(22) Filed: Feb. 27, 2004

(65) Prior Publication Data

US 2005/0189107 A1 Sep. 1, 2005

(51) Int. Cl.
*E21B 34/06* (2006.01)

(52) U.S. Cl. ..... 166/242.1; 166/325

(58) Field of Classification Search ..... 166/242.1, 166/325, 327

See application file for complete search history.

(56) References Cited

U.S. PATENT DOCUMENTS

| | | | | | |
|---|---|---|---|---|---|
| 2,178,845 | A * | 11/1939 | Baker | 166/223 |
| 2,804,830 | A | 9/1957 | Garrett et al. | 103/233 |
| 2,847,074 | A * | 8/1958 | Maly et al. | 166/325 |
| 3,292,708 | A * | 12/1966 | Mundt | 166/241.6 |
| 3,358,770 | A * | 12/1967 | Zandmer | 166/317 |
| 3,630,640 | A | 12/1971 | McMurray et al. | 417/54 |
| 3,834,414 | A | 9/1974 | McMurray | 137/155 |
| 4,049,057 | A * | 9/1977 | Hewes | 166/304 |
| 5,697,442 | A * | 12/1997 | Baldridge | 166/286 |
| 6,095,247 | A * | 8/2000 | Streich et al. | 166/299 |
| 6,293,346 | B1 * | 9/2001 | Patel | 166/373 |
| 6,457,528 | B1 * | 10/2002 | Staudt | 166/363 |
| 6,561,275 | B2 * | 5/2003 | Glass et al. | 166/317 |
| 2003/0164236 | A1 * | 9/2003 | Thornton | 166/278 |

FOREIGN PATENT DOCUMENTS

| | | |
|---|---|---|
| EP | 0 427 421 A2 | 5/1991 |
| GB | 2 171 436 A | 8/1986 |
| WO | WO 02/44516 A1 | 6/2002 |
| WO | WO 03/016674 A1 | 2/2003 |

OTHER PUBLICATIONS

Foreign communication from a related counterpart application Apr. 4, 2005.

* cited by examiner

*Primary Examiner*—Hoang Dang
(74) *Attorney, Agent, or Firm*—John W. Wustenberg; Baker Botts, L.L.P.

(57) ABSTRACT

The present invention is an apparatus for relieving annular fluid pressure between nested casing strings. The invention includes a pressure relief collar formed of a cylindrical housing and a set of end connections disposed on opposite sides of the cylindrical housing. The end connections join adjacent sections of casing string of the same diameter. A plurality of equally spaced centralizer blades are secured to the outer surface of the cylindrical housing. Each centralizer blade is equipped with a pressure relief mechanism, which opens the passage of fluid from an outer annulus between adjacent casing strings to an inner annulus between different adjacent casing strings and also prevents backflow of fluid. One or more inlet and outlet filters may also be employed to remove solids and other contaminants from the fluid entering the pressure relief mechanism. The invention also has application as a pressure relief collar for eccentric casing strings.

31 Claims, 15 Drawing Sheets

FIG.4
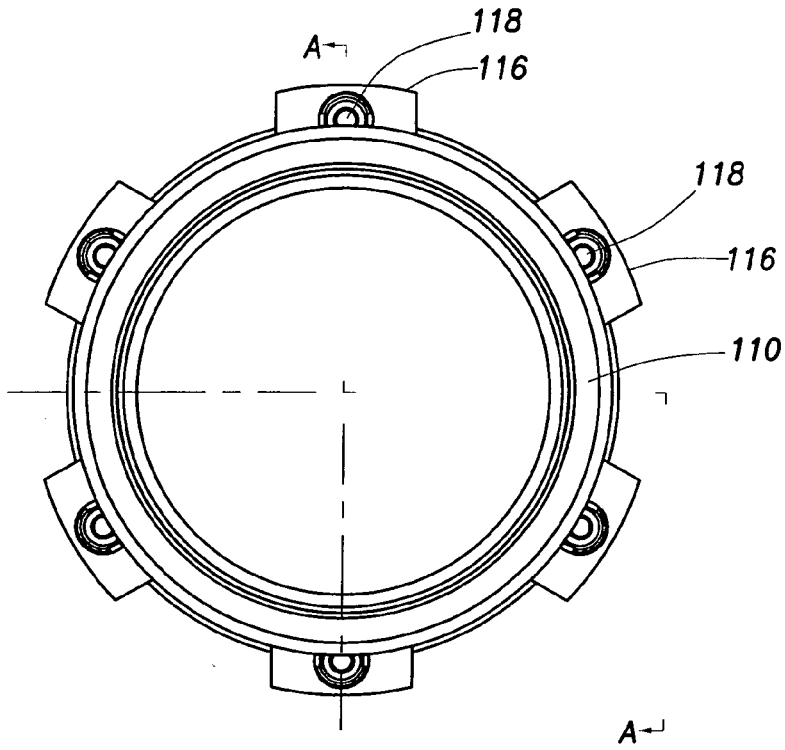
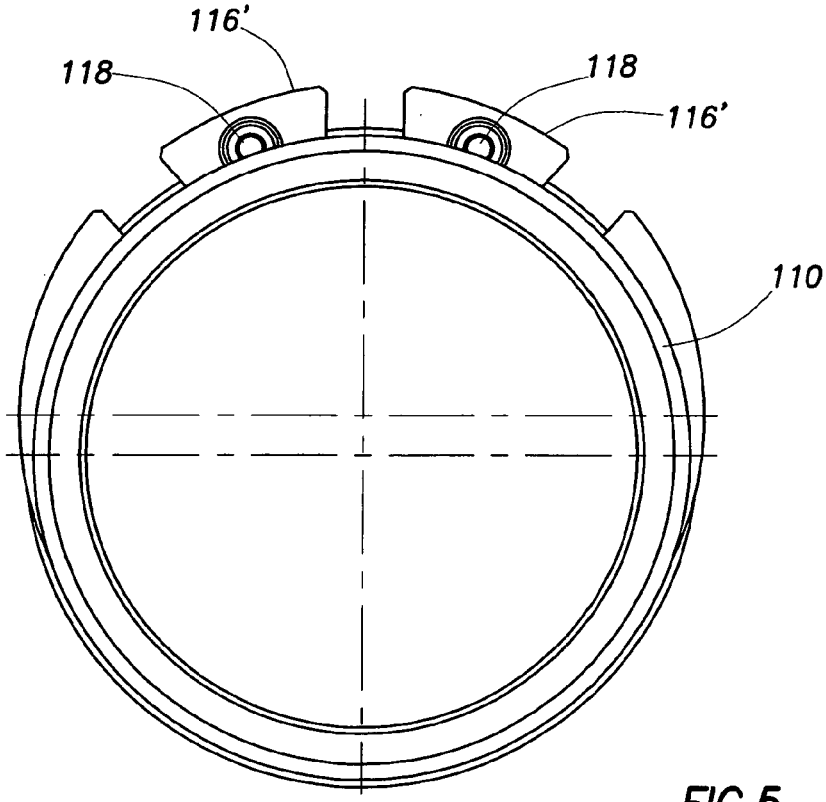
FIG.5

ANNULAR PRESSURE RELIEF COLLAR

BACKGROUND

The present invention relates generally to an apparatus for venting sustained casing pressure buildups in nested annuli of a downhole casing assembly, and more particularly to a trapped annular pressure relief collar, which passes the pressurized fluid toward the innermost annuli of the downhole casing assembly.

The Minerals Management Service (MMS) of the U.S. Department of the Interior is concerned about wells on the outer continental shelf that exhibit significant sustained casing pressure (SCP) because Congress has mandated that the MMS is responsible for worker safety and environmental protection. Sustained casing pressure is defined as pressure between the casing and the well's tubing, or between strings of casing, that rebuilds after being bled down. Sustained casing pressure is not due solely to temperature fluctuations nor is sustained casing pressure a pressure that has been deliberately applied, such as in a gas-lift scenario. In some respects, a small amount of sustained casing pressure in one or more annuli of a well may be viewed as inevitable in the operational life of a well, particularly when the well is operated well beyond its originally intended design life. However, a larger amount of sustained casing pressure can lead to a loss of well control (e.g., a blowout), a casing rupture or collapse, or the possible leakage of hydrocarbons outside of the well.

Sustained casing pressure can result from tubing leaks, casing leaks, and the establishment of flow paths through the cemented annulus due to poor primary cement quality, or damage to the primary cement after setting, and formations above the top of cement in each annuli. Tubing or casing leaks can result from a poor thread connection, corrosion, thermal-stress cracking, or mechanical rupture of the inner string. Wells are designed so that the innermost casings are the strongest for pressure containment. Only the production casing is generally designed to withstand the pressure of the deepest producing formation. Thus, production casing provides a redundant barrier to a blowout in the event of a failure of the production tubing, which allows the production tubing to be safely repaired. If the production casing fails, the next outer casing string is generally not designed to withstand formation pressure.

Sustained casing pressure can also originate within the same annulus experiencing the pressure build-up. Portland cement has been used by the oil and gas industry since the early 1900's as the primary means of sealing the area between the open borehole and the casing placed in the well. When set, some commonly used Portland cement formulations form brittle materials that are susceptible to cracking when exposed to thermally induced or pressure induced tensile loads. A primary cement job can be compromised in several ways to provide flow paths for gas migration. The most common problem occurring during primary cementing is the invasion of gas into the cement during the setting process. This may occur as cement gels and loses the ability to transmit hydrostatic pressure needed to hold back water and/or gas from formations. This can result in channels in the cement caused by flow from a formation after cementing. Mud quality while drilling can also affect the quality of the primary cement job. If the mud weight is too low, the result is borehole instability leading to borehole enlargements. Borehole enlargements and mudcake against the borehole that is not properly removed prior to cementing can cause poor bonding between cement and borehole, resulting in potential leak paths.

Even a flawless primary cement job can be damaged by common operations occurring after the cement has set. The casing and cement do not behave in a uniform manner due to the greatly differing ductile properties of metal and common types of cement. As a well is completed and produced the tubulars experience pressure and temperature cycles. This can result in casing diameter/length shrinkage and expansion relative to the cement causing separation or debonding of the casing from the cement. This process can cause the formation of a micro-annulus between casing and cement that will allow gas flow to the surface or to other lower pressure zones. Mechanical impacts experienced while tripping drill collars, stabilizers, and other tubulars can also cause cracks to develop in hardened cement. All of these operations can cause sustained casing pressure conditions to develop.

Finally, sustained casing pressure can be created by leakage from formations above the top of cement. During the cementing process lost circulation can occur and cause the top of cement to be lower than the position desired. As a result, some productive formations may not be covered by the cement. Furthermore, formations such as fractured shale, although thought to be non-productive, may be capable of producing sustained, minor amounts of hydrocarbons. The leakage through the wellbore mud from either source can result in sustained casing pressure.

While conventional wellheads typically provide a pressure relief line, which relieves the excess pressure from the "A" annulus (the innermost annuli), they provide no means for relieving the excess pressure from the other annuli, which can be numerous. Indeed, in a typical deepwater well, it is not uncommon to have a conductor casing, a surface casing, and multiple nested other casing strings, e.g., three or more, as well as the production casing, all of which have annuli formed there between, which are subject to the increases in fluid pressure identified above. One possible solution to this problem suggested by MMS is to modify existing wellheads, e.g., by providing one or more pressure relief lines that connect to, and bleed pressure from, each of the remaining annuli. A drawback of such a solution, however, is that it would be very expensive to implement, as wellhead design is quite complex and expensive.

Another solution is to employ expensive high-grade (i.e., high strength) casing for each layer of the casing and production tubing. A drawback to this solution, however, is that it also considerably increases the cost of completing the well given that often times thousands of feet of piping are employed in each deep well. Yet another but similar solution is to employ heavier casing (i.e., thicker) with a reduced internal diameter. A drawback of this solution is that the production flowpath is smaller than it could otherwise be, which in turn results in a less efficient production flow. If a certain production flowpath cross-sectional area is required, a larger bore would have to be drilled, which lengthens the required drill time at considerable extra cost. If a certain production flowpath cross-sectional area is not required, the reduced casing internal diameters would require smaller tools to be used to drill and complete lower sections of the well. Procurement of these smaller tools and the limited amount of force that can be applied to them while drilling slows the drilling process and adds further to costs.

SUMMARY

The present invention is an annular pressure relief collar that eliminates or at least minimizes the increased fluid pressures formed in the annuli between concentric well casings. The present invention provides considerable advantages over other solutions to the pressure problem.

In one embodiment, the present invention is an apparatus for relieving trapped annular fluid pressure between concentric casing strings. The apparatus includes a housing having an outer surface and a hollow inner cavity and a set of end connections disposed on opposite ends of the cylindrical housing, which are adapted to join adjacent sections of a casing string. Multiple blades are located on the external surface of the housing, which in one embodiment is cylindrical. The apparatus is adapted for installation between adjacent concentric casing strings. It also includes a pressure relief mechanism, which opens the passage of fluid from an annulus between adjacent concentric casing strings disposed outside of the housing to an annulus between different adjacent concentric casing strings disposed inside the hollow inner cavity when the annular fluid pressure reaches a predetermined value. A pressure relief mechanism is placed into each of the blades.

One advantage of this embodiment of the present invention is that the apparatus can also function as a casing string centralizer. This is accomplished through the multiple blades, which in one certain embodiment are equally spaced around the outer surface of the cylindrical housing. Each of the plurality of equally spaced centralizer blades comprises a top surface, two opposing side surfaces, two opposing end surfaces and a bottom surface, which it shares with the cylindrical housing. A central bore is formed through a substantial portion of each centralizer blade, which is open at one of the opposing end surfaces.

A pressure relief mechanism is placed into the central bore of each blade. In one certain embodiment, the pressure relief mechanism comprises a gas lift valve coupled to a check valve. The gas lift valve relieves pressure by enabling the trapped annular fluid to flow from the annulus formed outside of the cylindrical housing to the annulus formed inside of the cylindrical housing. The check valve prevents back flow of the fluid towards tubulars with potentially lower pressure ratings. As those of ordinary skill in the art will appreciate other pressure relief mechanisms may be employed.

The apparatus according to the present invention further includes at least one inlet filter and one outlet filter, which prevent solids and other contaminants from the fluid from entering the pressure relief mechanism, and thereby prevents clogging of the pressure relief mechanism. In one embodiment, one or more holes are formed through each of the blades and the inlet filter is mounted to the outside of each blade over the one or more holes.

In another embodiment, the inlet filter is formed inside of the central bore of each centralizer blade. In this embodiment, the inlet filter attaches to, and is in fluid communication with, the pressure relief mechanism. A pair of seals disposed on opposite ends of the inlet filter seal the inlet filter to the wall of the central bore so as to force fluid to flow through the inlet filter and then into the pressure relief mechanism. Fluid enters the central bore in this embodiment through at least one fluid inlet bore formed through each blade. In one certain aspect of this embodiment, a rupture disc is secured within the at least one fluid inlet bore. The rupture disc is designed to fail at a predetermined burst pressure. This arrangement is advantageous for a number of reasons. Inlet filters are not exposed to completion fluid during completion or during cementing when completion fluid and cuttings are displaced up the annulus back to the surface. After the well is completed the mud in the annular completion fluid will settle to the bottom of the annulus on top of the cement. By the time sufficient pressure builds in the annulus to burst the rupture discs the fluid adjacent the relief collars will be relatively clean in comparison to the originally homogeneous completion fluid. This means that the inlet filter will be filtering the cleanest possible annular fluid which will extend its useful life. Finally, rupture discs can be set to burst at different pressures for each blade, thus allowing additional pressure relief mechanisms in other blades to come into service as they are needed (as filters become less efficient from particulates and pressure rises again).

The at least one outlet filter is formed in a recess formed within each of the blades. The outlet filter is disposed downstream of the pressure relief mechanism and designed to prevent any contaminants from flowing back into the pressure relief mechanism.

The present invention may also be employed in eccentric casings where at least one blade is formed in the outer surface of the housing. In this embodiment, the outer surface of the housing and inner hollow cavity of the housing are cylindrical and eccentric to one another. In such embodiments, a central bore is formed through a substantial portion of the at least one blade. The various configurations of the inlet and outlet filters described above with respect to the centralizer embodiments may also be incorporated into the eccentric casing embodiments according to the present invention.

The features and advantages of the present invention will be readily apparent to those skilled in the art upon a reading of the description of the exemplary embodiments, which follows.

BRIEF DESCRIPTION OF THE DRAWINGS

A more complete understanding of the present disclosure and advantages thereof may be acquired by referring to the following description taken in conjunction with the accompanying drawings, which:

FIG. 4 is an end view of a centralizer version of an annular pressure relief collar in accordance with the present invention.

FIG. 5 is an end view of an eccentric bore version of an annular pressure relief collar in accordance with the present invention.

DETAILED DESCRIPTION

Figure 1:
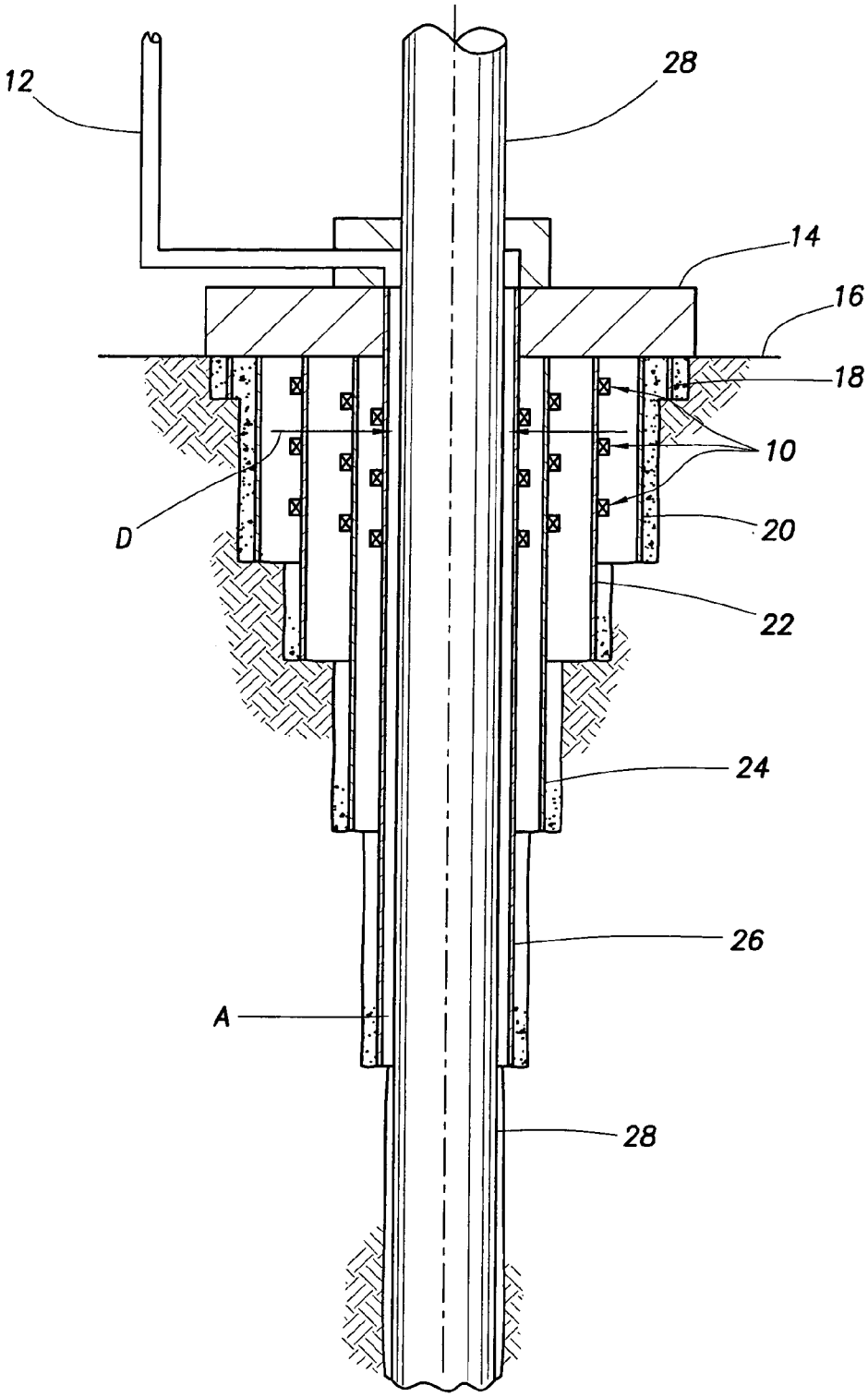
FIG. 1 is a schematic diagram illustrating a plurality of annular pressure relief collars according to the present invention, which join a corresponding plurality of nested casings shown disposed just beneath a subsea wellhead.
Figure 2:
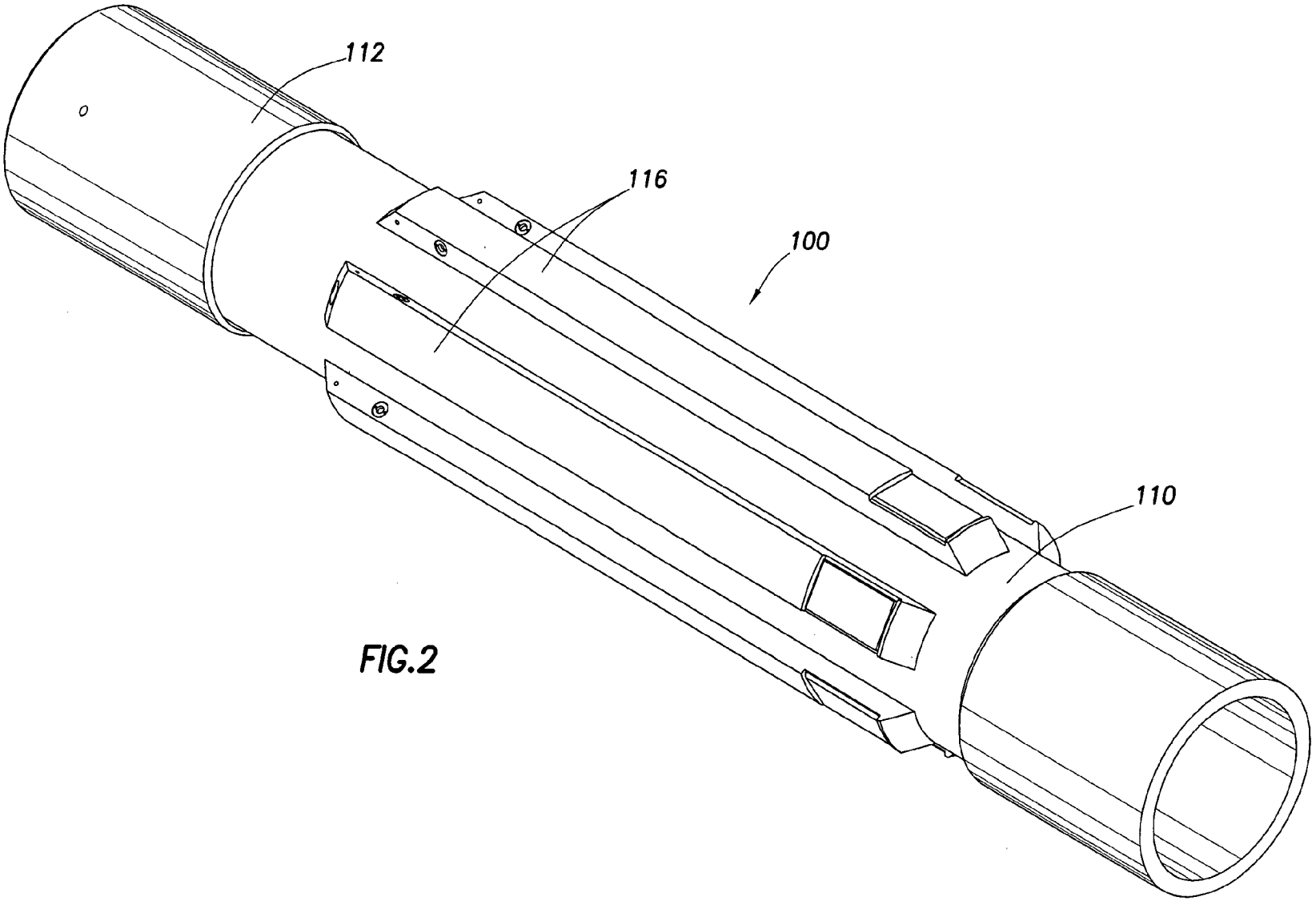
FIG. 2 is an isometric view of an annular pressure relief collar and centralizer in accordance with one embodiment of the present invention.

The details of the present invention will now be described with reference to the accompanying drawings. Turning to FIG. 1, a plurality of trapped annular pressure relief collars and centralizers in accordance with the present invention are shown generally by reference numeral 10. Each of the collars are used to join adjacent sections of casing string of the same diameter and are preferably formed using materials having properties consistent with that of the rest of the casing string. The plurality of collars operate to vent minor pressure buildups in the concentric annuli toward the Annulus A, which is the annulus between the production casing and the next innermost casing string. Arrow D in FIG. 1 illustrates the direction of flow of the pressurized fluid. As illustrated, the fluid moves from the outer annuli toward the inner annuli. In a certain exemplary embodiment, the pressured fluid will pass through at least one filtering device before it reaches one or more valves, which will vent greater pressure from the outer annuli to the inner annuli and prevent back-flow. In another certain exemplary embodiment, a second filtering device is provided for the fluid to pass through before reaching the inner annuli. The valve can be a combination pressure relief valve with an opening pressure setting to match the safe pressure limitations of the casing such as burst and collapse pressures and a fail-safe, normally closed type check valve. The filters remove solids from the fluid so the valve can function in a fluid environment.

The annular pressure relief collars (reference numeral 10) can be intentionally set at different known depths so that a temperature probe run in the production tubing/casing at a later date may be able to detect the depth of the collar or collars relieving pressure, thus giving indication to which annulus is experiencing sustained casing pressure.

Once the pressurized fluid reaches Annulus A, a pressure relief line 12, which is connected to, and in fluid communication with, Annulus A, delivers the fluid to the surface where the excess pressure can be bled off. In one certain exemplary embodiment, the pressure relief line 12 is formed into, or passes through, the wellhead 14.

Elevated levels of redundancy can be provided to insure the desired pressure relief. This is accomplished by placing a relief assembly in each blade of pressure relief collar as well as placing multiple pressure relief collars in each tubular string as desired by the operator. In one embodiment of the design, rupture discs in each blade can be set to burst at different pressures so as to add further redundancy by allowing additional pressure relief mechanisms in other blades to come into service as they are needed (as filters become less efficient from particulates and pressure rises again).

In the embodiment illustrated in FIG. 1, the wellhead 14 is a subsea wellhead, which is installed along subsea surface 16. However, as those of ordinary skill in the art will recognize, the present invention also has application in wells whose wellheads are above water on an offshore platform or onshore. The embodiment also illustrates a conductor casing 18, which in one exemplary embodiment has a diameter of 30 inches. Nested within the conductor casing 18 is a surface casing 20, which in one exemplary embodiment has a diameter of 26 inches. The embodiment illustrates four additional nested casings 22–28 with the innermost casing 28 being the production casing. In one certain exemplary embodiment, the casings 22–28 have diameters of 20 inches, 13⅜ inches, 9⅝ inches and 7 inches, respectively. As those of ordinary skill in the art will recognize, any number and size of nested casings may be employed depending upon a number of characteristics of the formation in which the well is placed, including but not limited to its geo-pressure profile, consolidation of sediments, and the nature and depth of the formation. In the specific embodiment illustrated in FIG. 1, trapped annular pressure relief collars are placed along casings 22, 24 and 26. As those of ordinary skill in the art should also recognize, more than one trapped annular pressure relief collar may be placed along each casing. Rather, a plurality of such devices may be placed along each such casing. Indeed, multiple valves in each pressure relief collar and multiple pressure relief collars installed along a casing string can provide the redundancy often desired by well operators and owners. Furthermore, since gas is the preferred fluid to pass through the valves, and because gas migrates towards the top of a well, the pressure relief collars are preferably placed towards the top of a well.

Figure 3:
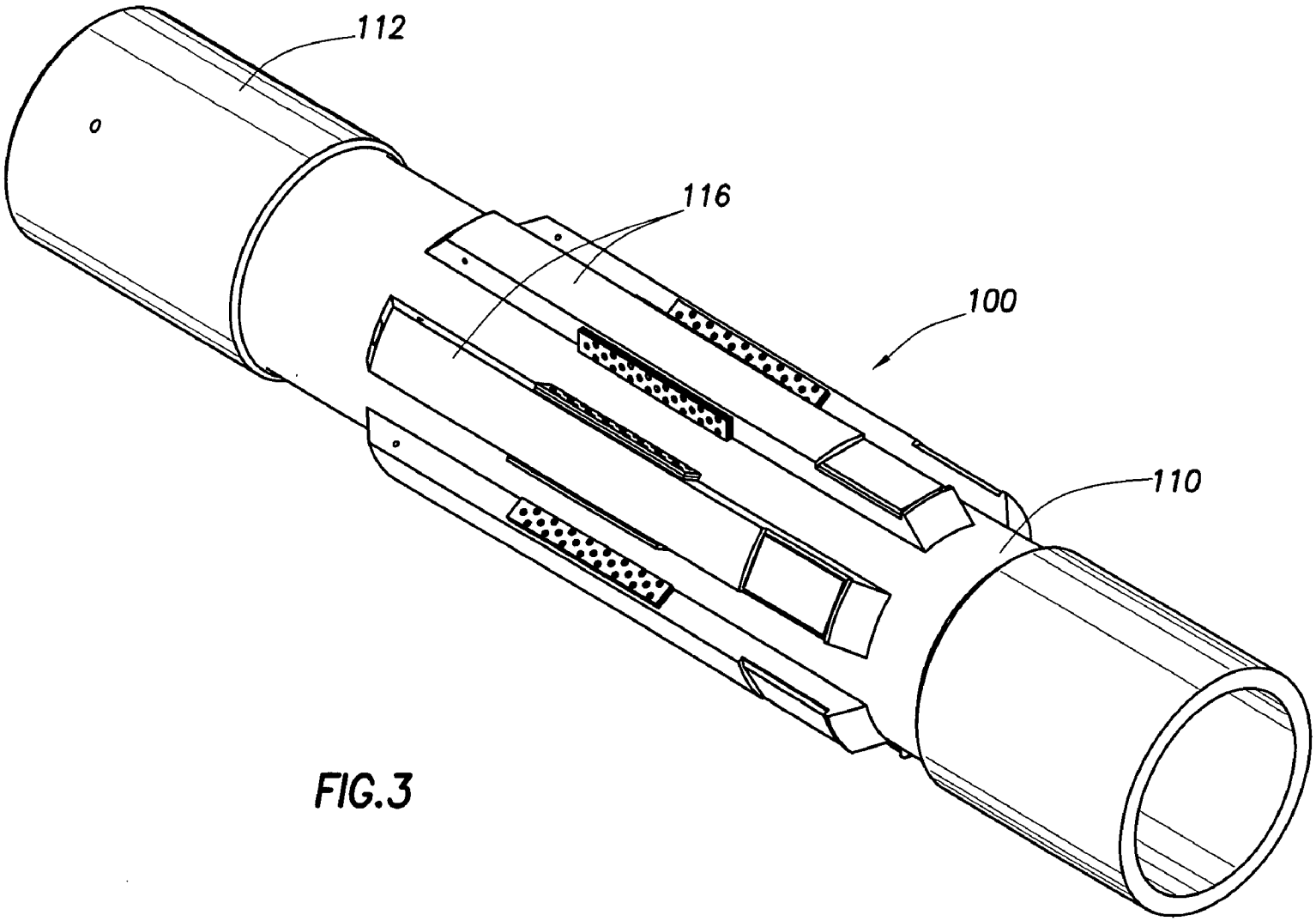
FIG. 3 is an isometric view of an annular pressure relief collar and centralizer in accordance with another embodiment of the present invention.
Figure 6A:
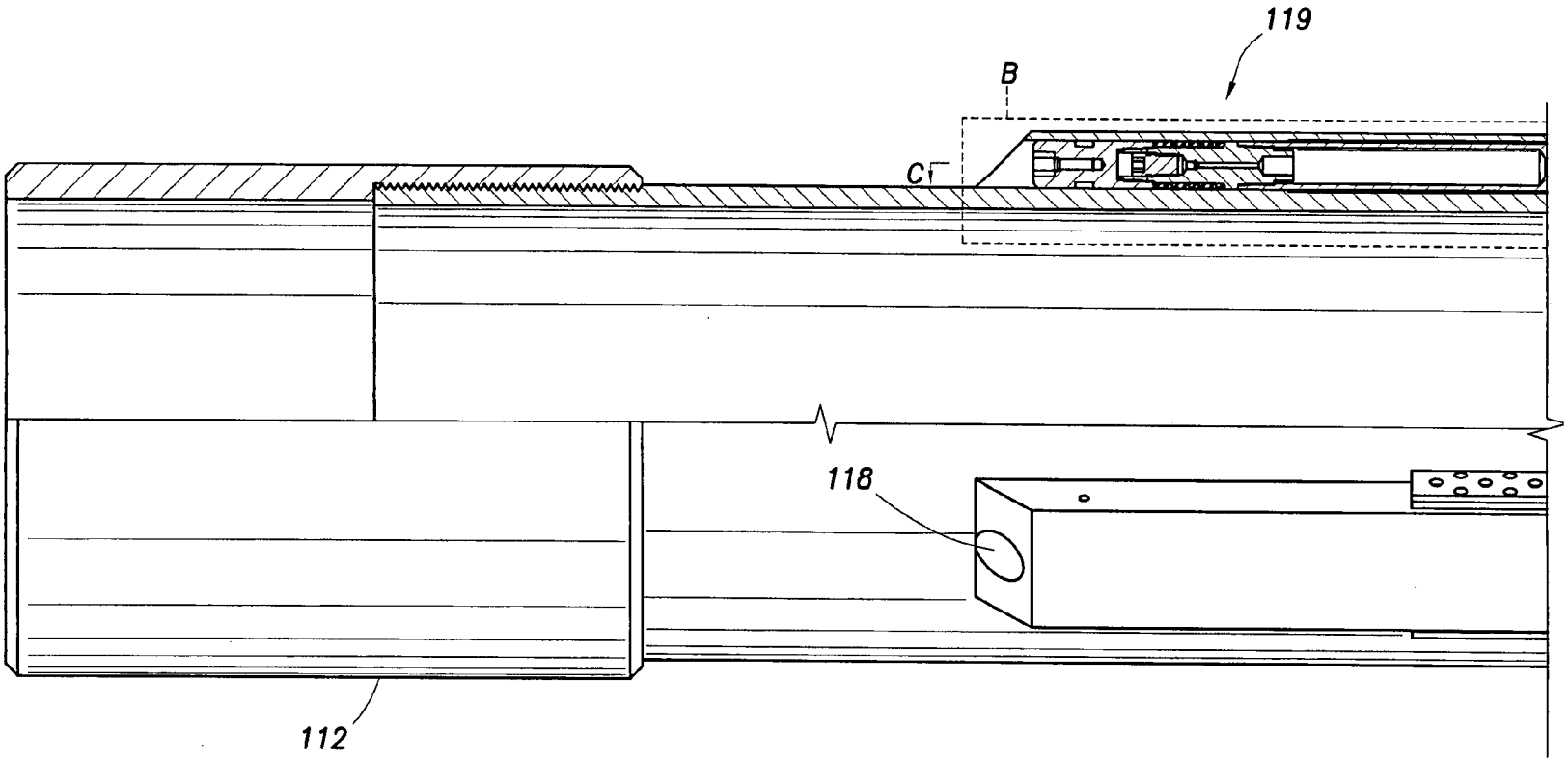
FIGS. 6A and 6B are a composite drawing with the top half being a partial longitudinal cross-sectional view of the annular pressure relief collar and centralizer shown in FIG. 3 and the bottom half being a view of the outer surface of the device.
Figure 6B:
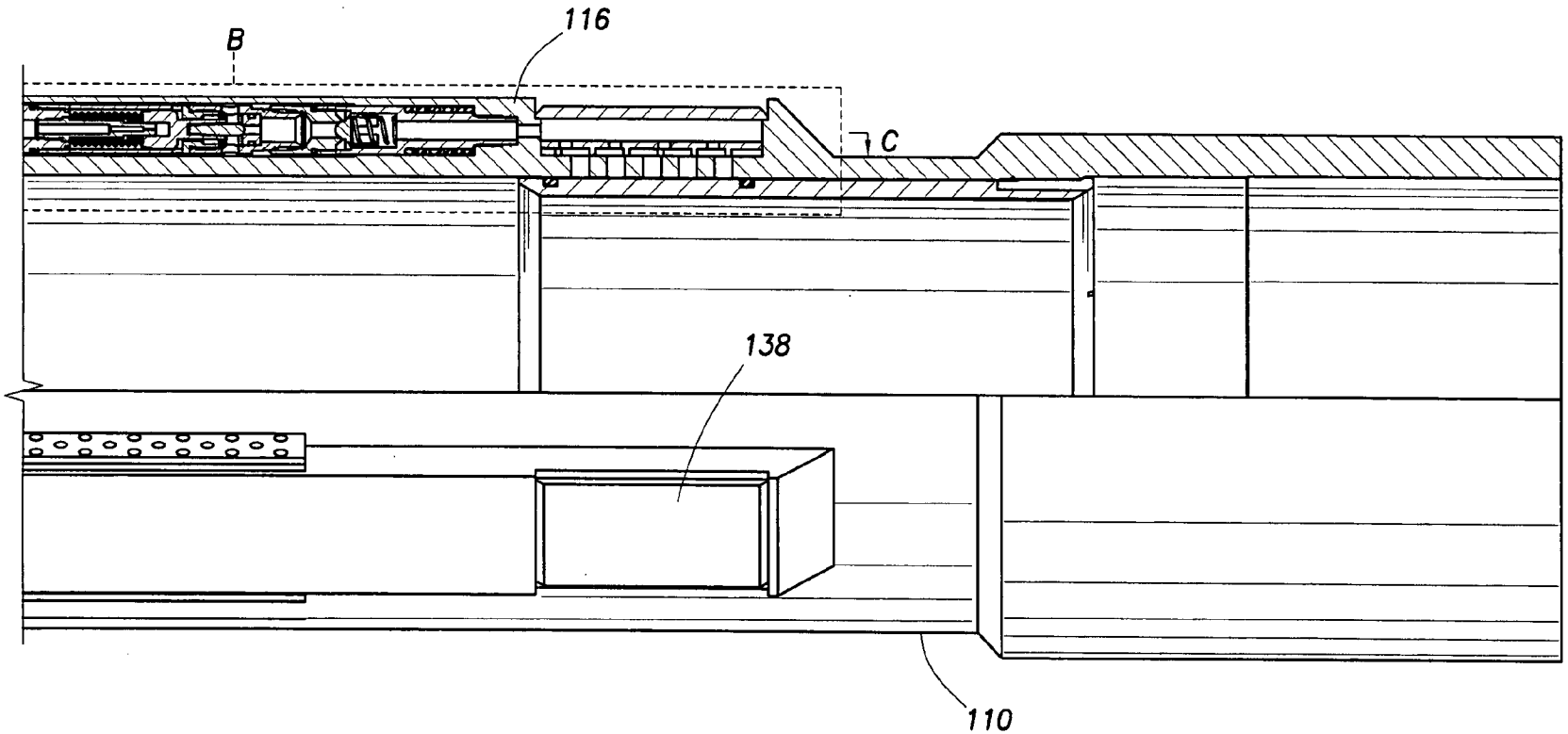

Turning to FIG. 3, the details of one embodiment of a pressure relief collar according to the present invention, designated generally by reference numeral 100, will now be described. The pressure relief collar 100 comprises a cylindrical housing 110 and a coupling 112 located on the top end of the cylindrical housing 110. The pressure relief collar 100 generally has female threads at each end used to mate with adjacent sections of casing string it joins, however, the pressure relief collar may be formed with male or female threads as desired. The pressure relief collar 100 further includes a plurality of centralizer blades 116, which are disposed on the outside surface of the cylindrical housing 110. The centralizer blades 116 function to center the pressure relief collar 100 and corresponding adjacent sections of casing string which they join within the well bore. They also function to allow the appropriate amount of fluid flow area between the blades as specified in API RP-65, which specifies the minimum annular size for flow restrictions by setting clearance and lost circulation guidelines. In the embodiment of FIG. 3, six equally spaced centralizer blades 116 are disposed around the outside surface of the cylindrical housing 110. As those of ordinary skill in the art will appreciate more or less than six centralizer blades may be employed depending upon the diameter of the pressure relief collar 100 and other design constraints, such as API-RP65, apparent to those skilled in the art. The details of each blade and the pressure relief assembly disposed within each such blade will be further described immediately below.

Figure 7A:
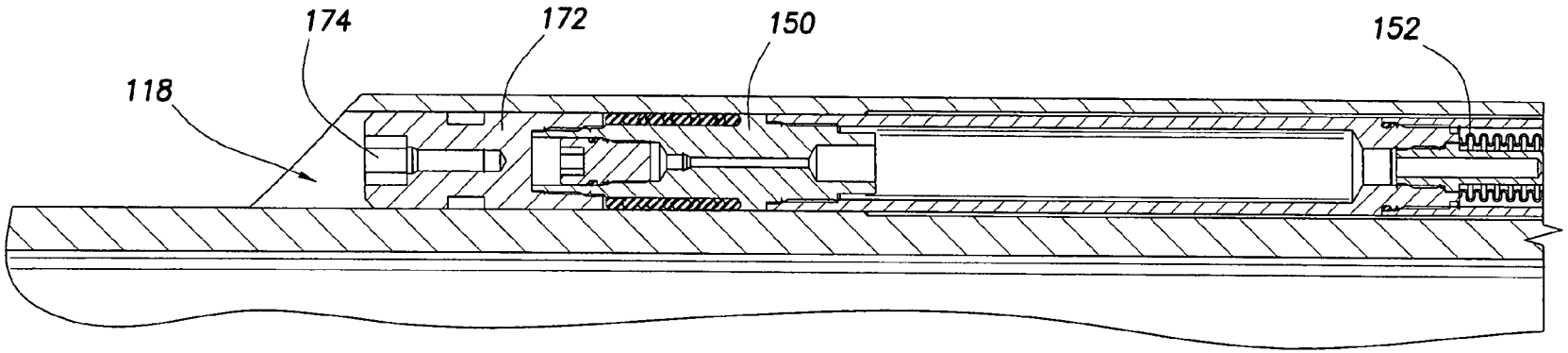
FIGS. 7A and 7B are an enlarged view of the cross-section of the annular pressure relief collar and centralizer contained within Box B shown in FIGS. 6A and 6B.
Figure 7B:
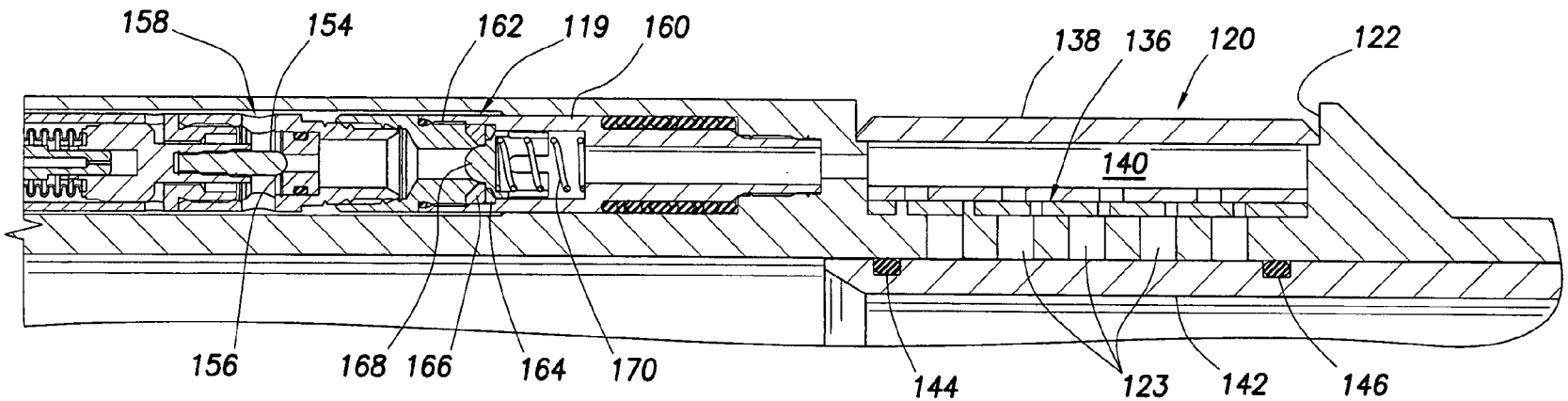
Figure 8A:
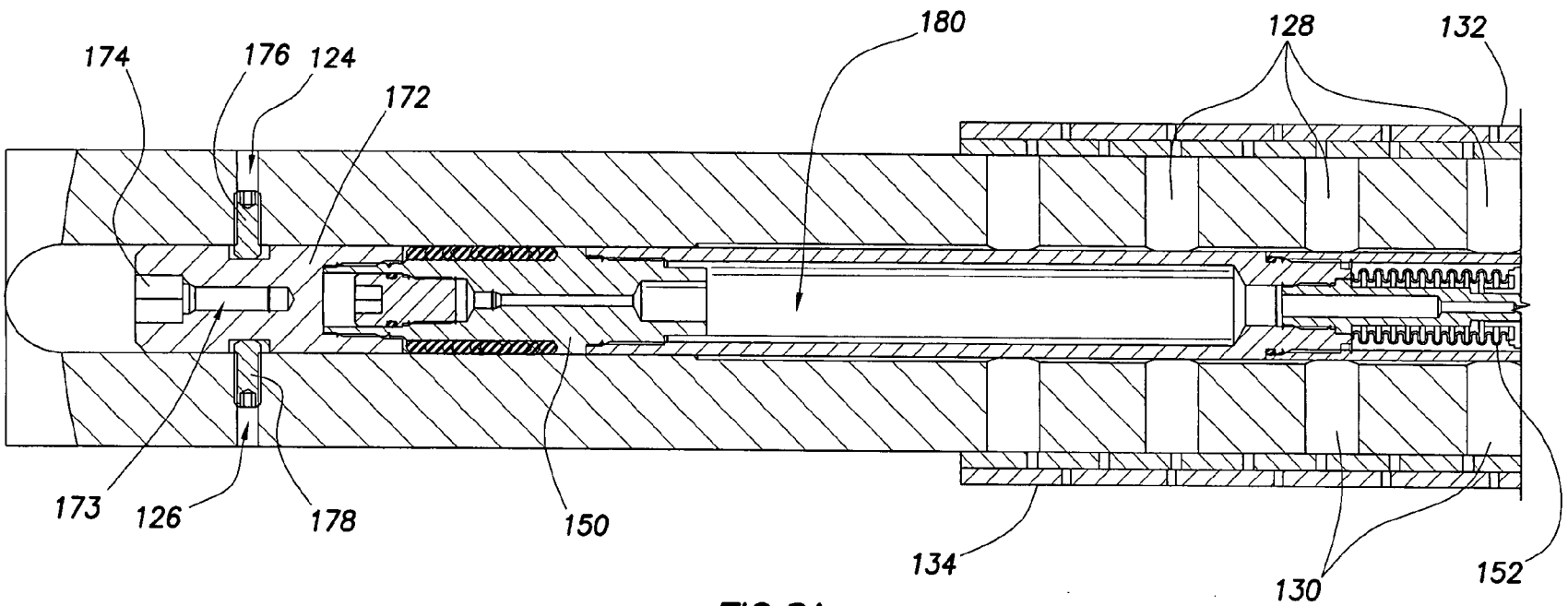
FIGS. 8A and 8B are an enlarged cross-sectional view of the annular pressure relief collar and centralizer taken along line C—C, which is perpendicular to the view shown in FIGS. 7A and 7B.

Each centralizer blade 116 has a top surface, two opposing side surfaces, two opposing end surfaces and a bottom surface, which may be integrally formed with the body of the cylindrical housing 110. A central bore 118 is formed through the center of each blade 116, as shown in FIG. 7. A pressure relief mechanism 119, whose structure, function and operation is described below, is secured within the central bore 118. Furthermore, a recess 120 having a shoulder 122 is milled into one end of each centralizer blade 116, as shown in FIG. 7B. A plurality of holes 123 are formed through the bottom surface of each recess 120. The plurality of holes 123 enable fluid to flow from an outlet of the pressure relief assembly 119 into an inner annulus formed inside of the cylindrical housing 110. Each centralizer blade 116 also has a pair of screw bores 124 and 126 milled into one end of each of its sides, as shown in FIG. 8A. Additionally, each centralizer blade 116 has two sets of opposed holes 128 and 130 formed through its opposing sides, respectively, as also shown in FIG. 8A. The sets of opposed holes 128 and 130 enable fluid to flow from within an outer annulus to the pressure relief collar 100.

A pair of inlet filters 132 and 134 are attached to the opposing side surfaces of each centralizer blade 116 over sets of opposed parallel holes 128 and 130, respectively, as shown in FIG. 8A. The inlet filters 132 and 134 are attached to the opposing side surfaces of each centralizer blade 116 using known techniques, including, e.g., welding or brazing. In one embodiment, the filtering devices 132 and 134 are formed of a rigid mesh screen, e.g., the type used for sand control such as a POROMAX sand control screen. As those of ordinary skill in the art will appreciate, however, any suitable device, which can withstand the harsh downhole environment and remove effective amounts of solids from a fluid, can be used. The inlet filters 132 and 134 filter the fluid flowing into the pressure relief mechanism 119.

An outlet filter 136 may also be employed to filter any solids that may try to flow back into the pressure relief mechanism 119 from an inner annulus. More specifically, the outlet filter 136 keeps particulate material out of the check valve 160, which if became lodged in the check valve could detrimentally force the check valve to remain open. The outlet filter 136 is preferably formed of the same material used to form the pair of filtering devices 132 and 134. It is secured within recess 120, preferably by welding, brazing or some other known equivalent technique, as shown in FIG. 7B. A plate 138 is secured against shoulder 122 in recess 120 just above the third filtering device 136. A sealed fluid chamber 140 is formed between the plate 138 and the outlet filter 136. The plate 138 is also welded, brazed or similarly secured in recess 120. The plate 138 is preferably formed of the same steel alloy used in forming the cylindrical housing 110, however, as those of ordinary skill in the art will appreciate other suitable materials, which can withstand the high fluid pressures, may be used. Furthermore, the plate 138 is preferably sealed so as to prevent the flow of unfiltered fluid from outside the centralizer blade 116 into the fluid chamber 140.

An opening sleeve 142 is secured to the inner circumferential surface of the cylindrical housing 110, which is also the bottom side surface of the centralizer blade 116. A pair of O-rings 144 and 146 (shown in FIG. 7B) prevents fluid from flowing past the opening sleeve 142 into the centralizer blade 116. The opening sleeve 142 prevents cement from plugging the filtering device 136, check valve 160, and other internal components of the pressure relief collar 100 while the casing string is cemented in place and before the valve is placed in operating condition. The opening sleeve is preferably formed of an easily millable material, such as a rigid thermoplastic, cast iron, or soft metal. It is designed to be milled out of the pressure relief collar 100 after the lower portion of the casing string is cemented in place below the collar. The material selected must be able to withstand downhole fluid pressures during cementing the string into place without failure.

The details of the pressure relief mechanism 119 will now be described. The pressure relief mechanism 119 comprises a gas lift valve 150 and a check valve 160. The gas lift valve has a bellows 152, as shown in FIGS. 7A and 8A. In one exemplary embodiment, the gas lift valve 150 is a modified Camco J-40 valve with added V packing, which has a one inch outer diameter, and the bellows is a multi-ply Monel bellows. The bellows 152, which is nitrogen-charged, provides the force necessary to maintain the valve 150 in a normally closed position. The valve 150 has a plunger 154, which is biased against the seat 156 by the nitrogen charge inside the bellows 152. This is the closed position. In operation, the pressurized annular fluid enters the valve 150 via valve inlet 158 and acts on the effective bellows area. As the annular pressure overcomes the precharged nitrogen pressure in the bellows 152, the bellows contracts along the axis of 118 lifting the plunger 154 off the seat 156 and thereby allowing annular fluid to pass through the valve.

Figure 8B:
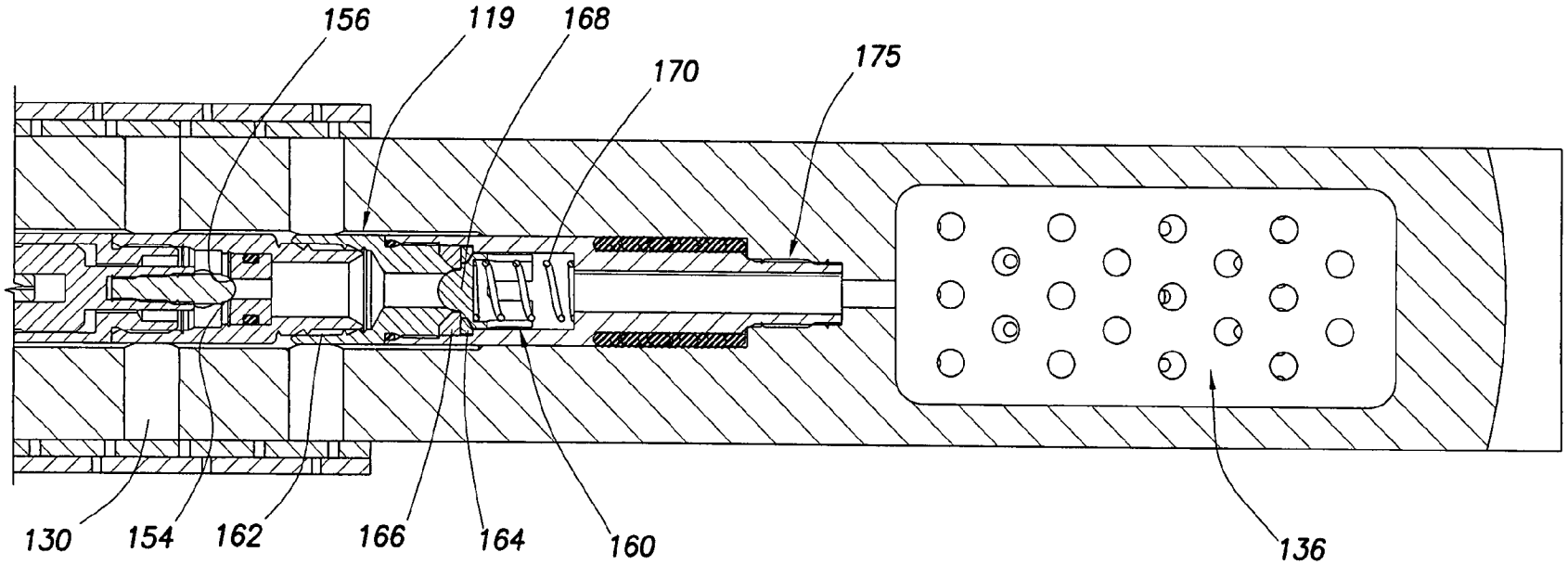
Figure 9A:
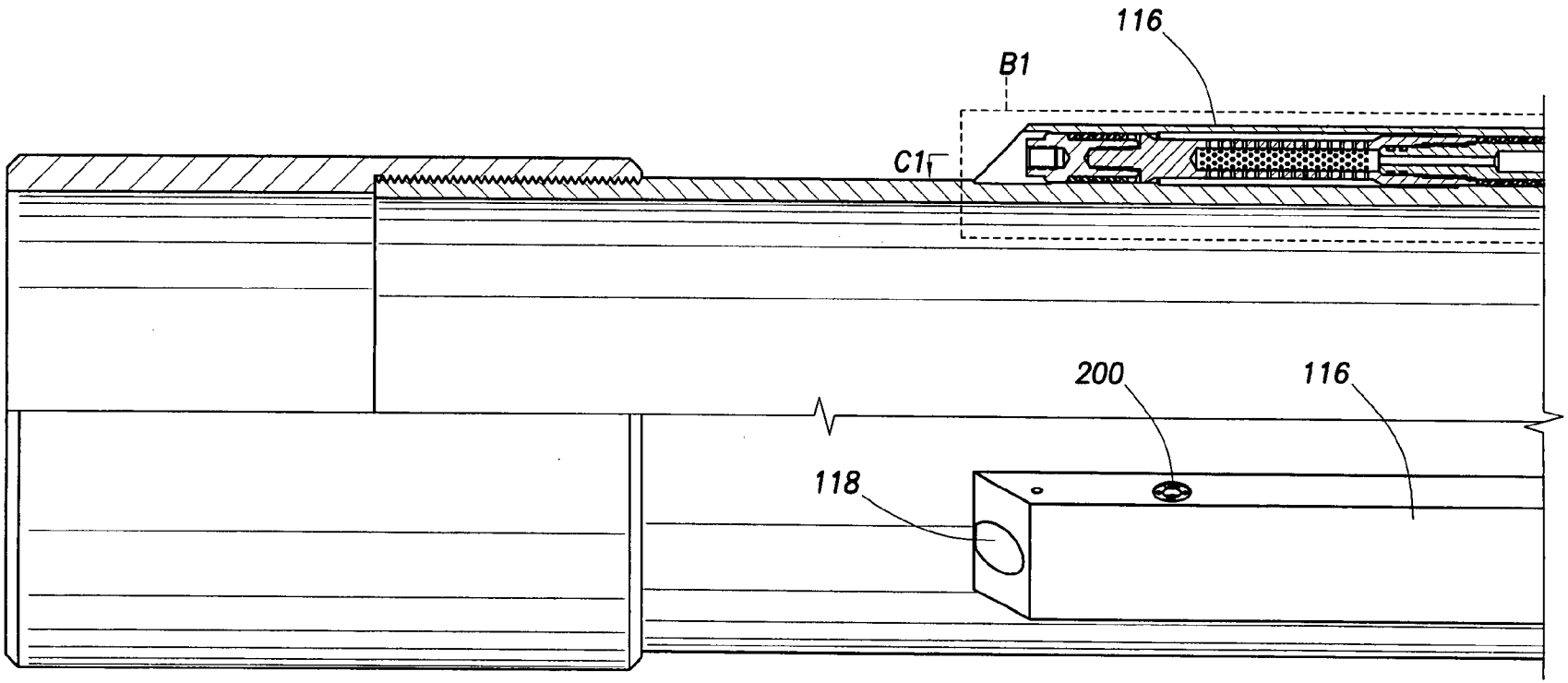
FIGS. 9A, 9B, & 9C are a composite drawing with the top half being a partial longitudinal cross-sectional view of the annular pressure relief collar and centralizer shown in FIG. 2 and the bottom half being a view of the outer surface of the device.
Figure 9B:
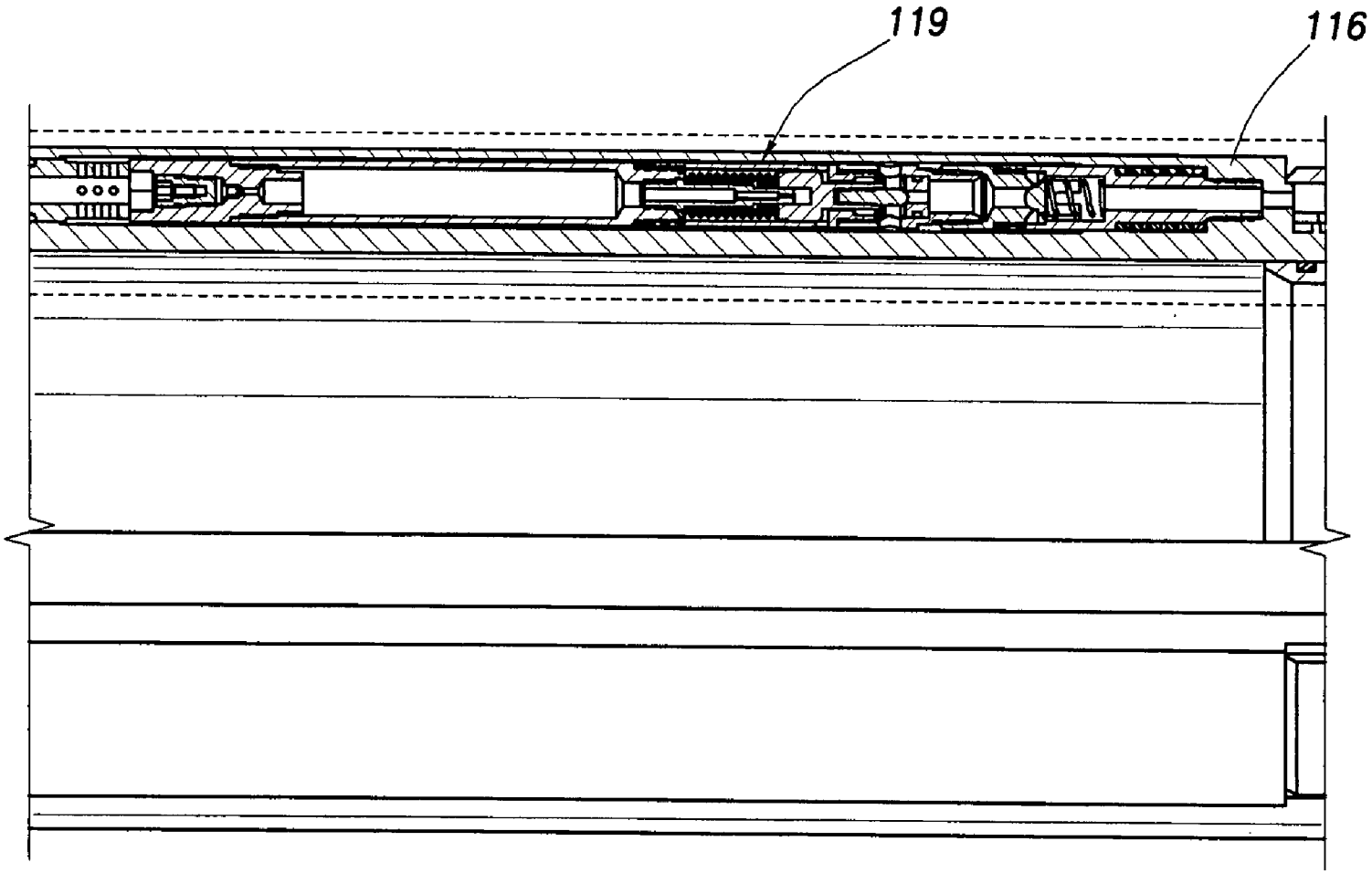
Figure 9C:
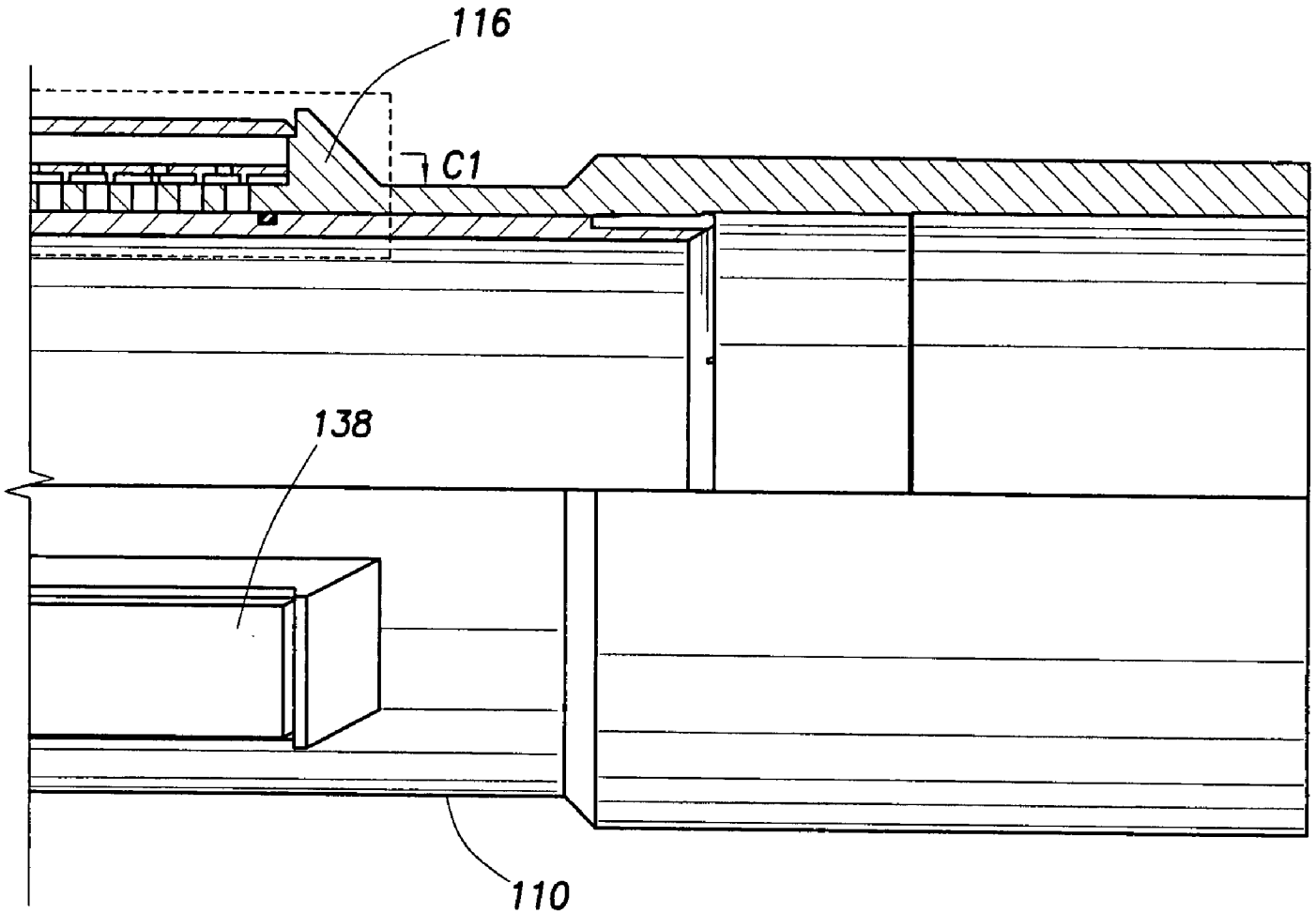

The pressure relief mechanism 119 further comprises a check valve 160, which in one exemplary embodiment is a modified Camco B-1 check valve with added V packing, as shown in FIGS. 7B and 8B. The gas lift valve 150 is axially coupled to the flow check valve 160 via a ½-14 NPT (in.-TPI) connecting thread 162. The modified Camco B-1 check valve used in the present invention is a positive check valve and has a one inch outer diameter. The valve has a soft elastomeric seat 164, a hard stainless steel seat 166 disposed beneath the soft elastomeric seat 164 and a stainless steel check dart 168, which is initially sealed against the soft seat 164 by a spring 170 (e.g., Camco model number 01081-002). The check valve 160 is threaded at one end, which engages a threaded recess formed at an end of the central bore 118. The check valve 160 operates to prevent a back flow of the annular fluid from the inner annulus toward the outer annulus. It thus helps ensure that potentially higher pressure fluid contained in smaller casing strings does not contact larger casings that typically have lower pressure ratings than smaller casings. It also moves the fluid from the outer annuli of the casing assembly toward the inner Annulus A. Multiple check valves 160 could be installed between gas lift valve 150 and outlet filter 136 as required by lengthening central bore 118. In an alternative embodiment, it might be discovered that fluid is sufficiently clean such that back-flow filter 136 becomes unnecessary.

The pressure relief mechanism 119 further comprises a mounting receptacle 172 formed with a hex socket 174 and standard screw thread 173, as shown in FIGS. 7A and 8A. Hex socket 174 is adapted to receive a hex tool or other similar device for installing the pressure relief assembly 119 using thread 175 within the central bore 118. A pair of set screws 176 and 178 fit within screw bores 124 and 126, respectively, to secure the pressure relief assembly 119 in place once installed within the central bore 118. A typical screw can be installed in the standard screw thread 173 located within mounting receptacle 172 to aid in removal of the pressure relief mechanism 119 from the central bore 118 should removal be required.

The steps of manufacturing and assembling the pressure relief collar 100 in accordance with the present invention will now be described. First, a conventional integral solid centralizer is designed and manufactured, which has a plurality of solid centralizer blades 116 formed on or integral to its outer cylindrical housing. Next, a one inch diameter bore (central bore 118) is milled approximately 75% of the way down the center axis of each centralizer blade 116. Next, a thread is tapped into the end of the central bore 118 opposite its opening. Next, a plurality of bores are milled completely through each of the opposing side surfaces of the centralizer blade 116, so as to form the two sets of opposed holes 128 and 130. Tapped screw bores 124 and 126 are also created. Next, a rectangular notch is milled into the top surface of the centralizer blade 116, so as to form recess 120 and corresponding shoulder 122. Next, a plurality of bores are milled completely through the bottom of recess 120 to form holes 123. The outlet filter 136 is then welded in the recess 120. Next, the plate 138 is welded to shoulder 122. The inlet filters 132 and 134 are then welded to opposing side surfaces of the centralizer blade 116 adjacent, and completely covering, the two sets of opposed holes 128 and 130, respectively.

Next, the pressure relief mechanism 119, which has been pre-assembled by coupling the gas lift valve 150 to the check valve 160, is installed within the central bore 118 by threading it in place with a hex tool. The pressure relief assembly 119 is then secured in place with set screws 176 and 178. Finally, the opening sleeve 142 is installed by screwing it into place on the inside surface of the cylindrical housing 110 of the pressure relief collar 100 adjacent the plurality of holes 123. O-rings 144 and 146 create a seal over holes 123, which will be opened to the inside annulus by destruction of the opening sleeve 142 after the pressure relief collar 100 is installed in the well and the string is cemented in place.

These steps are then repeated for each centralizer blade 116. As those of ordinary skill in the art will appreciate, the exact order in which these steps are performed is not critical. For example, the order in which the filters are installed or bores milled can be reordered without effecting the ability to manufacture and assemble the pressure relief collar 100 in accordance with the present invention. Those of ordinary skill in the art will appreciate the priority in which certain steps must be carried out.

The installation of the pressure relief collar 100 in accordance with the present invention will now be described. First, the pressure relief collar 100 is coupled to adjacent sections of casing string having the same diameter. This step is performed at the surface. Next, the casing string joined by the pressure relief collar 100 is lowered into the well bore to the desired depth using known techniques, e.g., with a rig. Next, the casing string containing the pressure relief collar 100 is cemented in place. The pressure relief collar is installed in the casing string in a position that prevents its external exposure to cement. Finally, the opening sleeve 142 is drilled out of the pressure relief collar 100 with a clean completion fluid and the casing string is ready for the next operation, which may include drilling to deeper well depths and installing a smaller diameter casing or production string. As those of ordinary skill in the art will appreciate, more than one pressure relief collar 100 may be installed for each diameter casing string.

Finally, the operation of the pressure relief collar 100 once installed will now be described. Pressurized fluid from an outer annulus between two concentric casing strings flows through the filters 132 and 134. The filters 132 and 134 remove solids from the fluid so as not to clog the valves 150 and 160 of the pressure relief collar 100. The pressurized fluid then flows through the two sets of opposed parallel holes 128 and 130 into the central bore 118. The pressurized fluid then flows into the gas lift valve 150 through the valve inlet 158. It acts on the effective bellows area. Once the pressure reaches a certain predetermined valve, e.g., generally 600–1000 psi, it overcomes the precharged nitrogen pressure contained in cavity 180 inside the bellows 152, thereby causing the bellows to contract axially, which in turn lifts the plunger 154 off the seat 156. Once the gas lift valve 150 is opened, the pressurized fluid flows by seat 156 toward the check valve 160, which as described above operates to prevent the back flow of the fluid. If the outer annulus fluid pressure is greater than the inner annulus fluid pressure, then the forward pressure from the fluid causes the check dart 168 to unseat from the soft elastomeric seat 164, which in turn allows the fluid to continue to flow through the centralizer blade 116 toward the fluid chamber 140. After passing through the fluid chamber 140, the pressurized fluid flows through filter 136 into the plurality of holes 123 and out into an inner annulus inside of the pressure relief collar 100. This occurs through each of the centralizer blades 116. With reference back to FIG. 1, it can be seen that with a plurality of pressure relief collars 100 mounted along casing strings of varying diameter, the fluid can flow in the direction D, i.e., from the outer annuli toward the Annulus A and ultimately out of the well via pressure relief line 12.

The present invention lends itself to at least three additional embodiments. One such additional embodiment is another pressure relief collar that also functions as a centralizer. This additional embodiment is shown in FIGS. 2 and 9–11 and will now be described. This embodiment is nearly identical to the embodiment shown in FIGS. 3 and 6–8. Indeed, the pressure relief mechanism 119 is identical as well as the outlet filter 136 design. This embodiment also employs equally spaced centralizer blades 116. The primary difference between the embodiment of FIGS. 2 and 9–11 from that of FIGS. 3 and 6–8 is that the inlet filter in the embodiment of FIGS. 2 and 9–11 is placed inside of the each centralizer blade 116. This configuration may be advantageous in certain downhole environments, where placement of the collar into the well bore may prematurely plug the inlet filters 132 and 134.

Figure 10A:
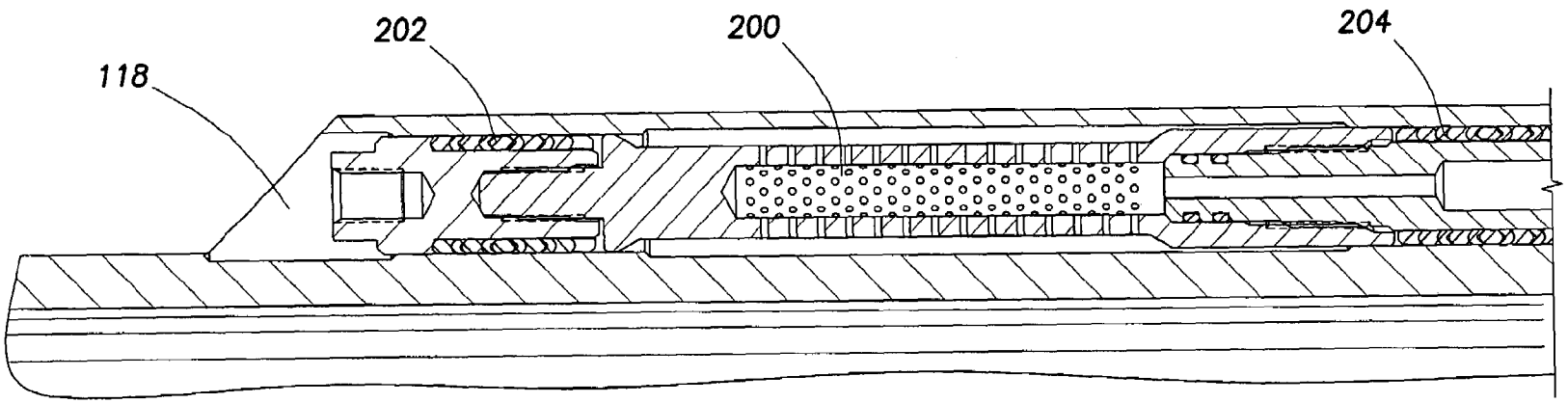
FIGS. 10A, 10B, & 10C are an enlarged view of the cross-section of the annular pressure relief collar and centralizer contained within Box B shown in FIGS. 9A, 9B and 9C.
Figure 10B:
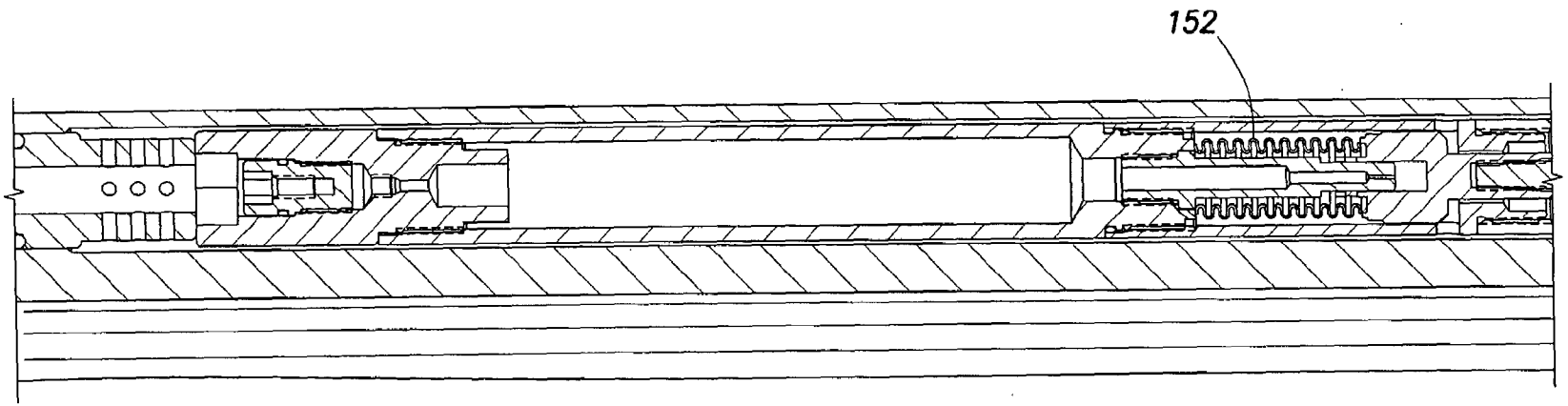
Figure 10C:
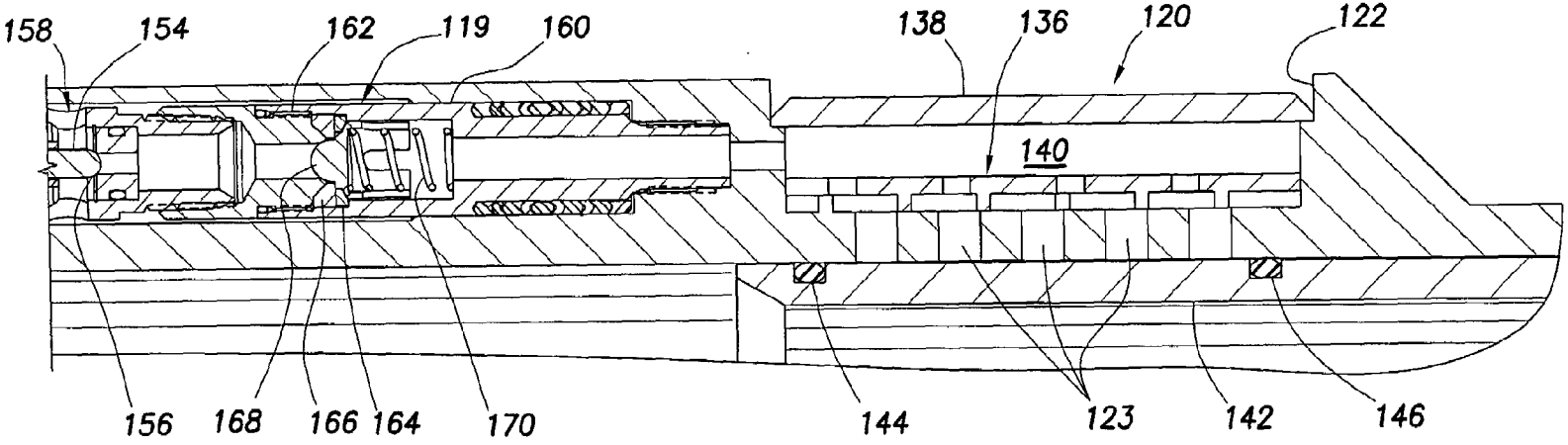
Figure 11A:
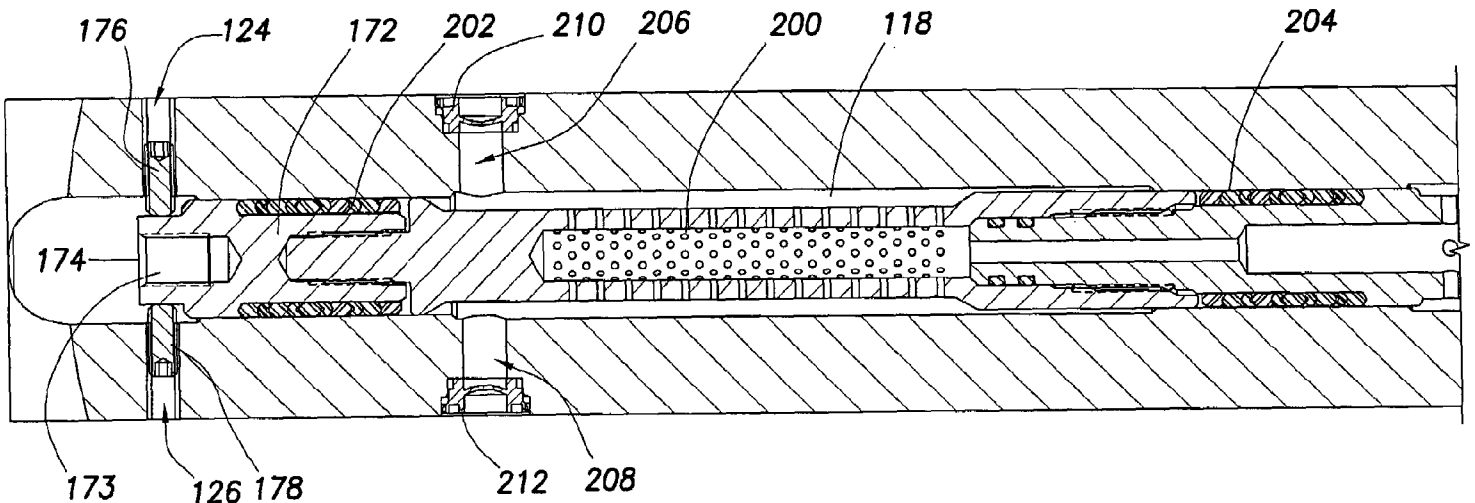
FIGS. 11A, 11B & 11C are an enlarged cross-sectional view of the annular pressure relief collar and centralizer taken along line C—C, which is perpendicular to the view shown in FIGS. 10A, 10B, & 10C.
Figure 11B:
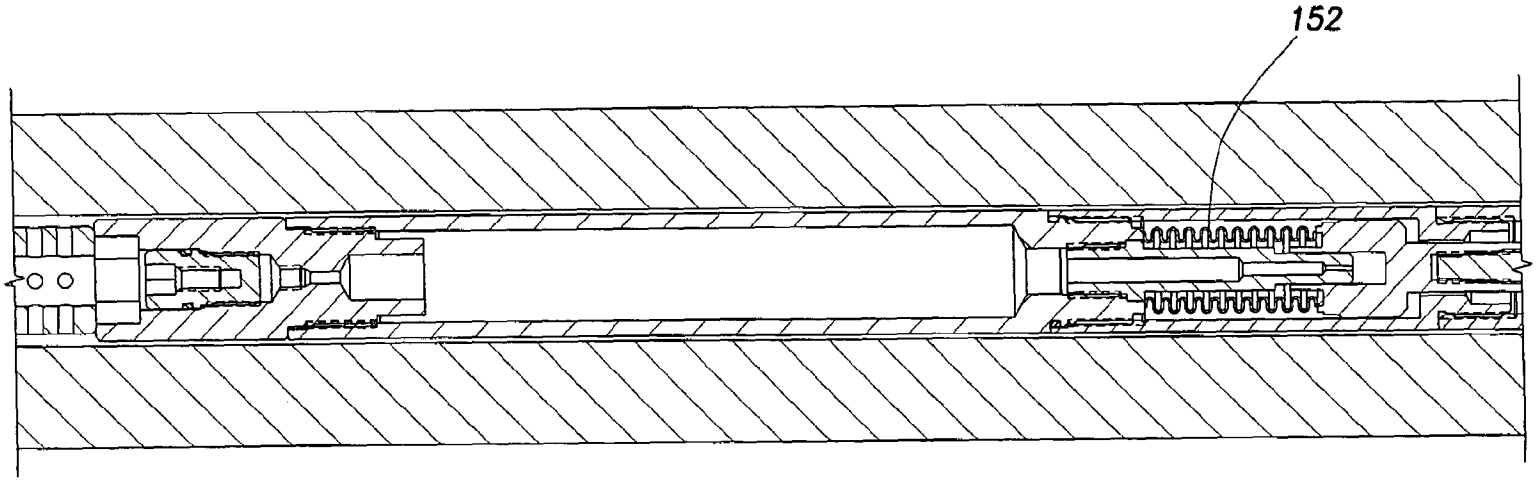
Figure 11C:
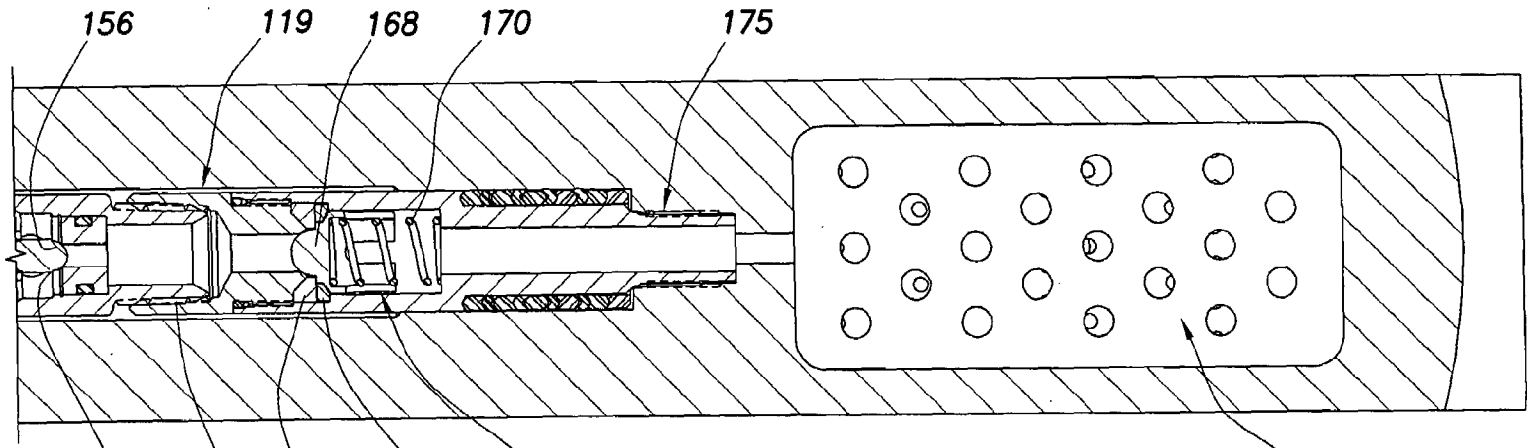

The details of inlet filter of the embodiment shown in FIGS. 3 and 9–11 will now be described. In this embodiment, inlet filter 200 is shown in FIG. 10A. Inlet filter 200 is generally cylindrical in shape and formed with a plurality of holes around its entire circumference and along its axis. The inlet filter 200 is placed in central bore 118 adjacent and upstream from relief mechanism 119. A pair of V-packing seals 202 and 204 are disposed at opposite ends of the inlet filter 200, as also shown in FIG. 10A. The V-packing seals 202 and 204 seal against the inner wall of the central bore 118 and thereby force annular fluid entering into the central bore 118 to flow through the inlet filter 200 before reaching pressure relief mechanism 119. Fluid enters into the central bore 118 in this embodiment through a pair of inlet ports or bores 206 and 208, which are shown in FIG. 11A. A corresponding pair of rupture discs 210 and 212 are disposed within the pair of inlet ports 206 and 208, respectively, to block the flow of fluid into the central bore until the annular fluid pressure reaches a desired predetermined burst value. One example of a suitable rupture disc is Oseco part number W06-7601-401. However, as those of ordinary skill in the art will appreciate, other types of rupture devices may be employed.

The operation of the embodiment illustrated in FIGS. 2 and 9–11 will now be described. Once the annular fluid pressure outside of the housing 110 reaches the predetermined burst pressure of the rupture discs 210 and 212, these devices fail thereby permitting fluid to enter the central bore 118 of blade 116. Rupture discs 210 and 212 are duplicates and are set to rupture at the same pressure. Similar discs in different blades of the same relief collar could be set to burst at higher pressures, thus opening new pressure relief flowpaths if filters in existing flowpaths become clogged. The V-packing seals 202 and 204 force the fluid to pass through the inlet filter 200, which in turn removes particulate material from the fluid. After the fluid passes through the inlet filter 200 it then continues on downstream, passing through the pressure relief mechanism 119, as the inlet filter 200 and pressure relief mechanism are in fluid communication, and the outlet filter 136, as described above. This embodiment is installed in the same manner as the embodiment of FIGS. 3 and 6–8. It is also constructed in the same manner, except the inlet filter 200 is axially secured in the central bore 118 by set screws 176 and 178. Furthermore, the rupture discs 210 and 212 are installed using known techniques.

In another aspect, the present invention can be used as a pressure relief collar for eccentric casing strings. This version of the present invention is shown in FIG. 5 and differs from the centralizer versions of the present invention described above, and shown generally in FIG. 4, in that the main production fluid flow path is not centered in the well bore. In this configuration of the present invention, the outer surface of the cylindrical housing 110 is eccentric to the inner hollow cavity of the cylindrical housing, as shown in FIG. 4. One, two or more blades 116' may be formed in this version of the pressure relief collar. However, as should be evident to those of ordinary skill in the art, the blades 116' in this version of the present invention do not perform a centralizing function. Rather, their primary function is to house the pressure relief mechanism, and in the case of the embodiment of FIGS. 2 and 9–11, the inlet filter. As those of ordinary skill in the art should also appreciate, both of the embodiments of the present invention described above, namely that shown in FIGS. 2 and 9–11 and that shown in FIGS. 3 and 6–8, can be incorporated into the eccentric collar version of the present invention. Accordingly, the present invention lends itself to at least four discrete embodiments.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. An apparatus for relieving trapped annular fluid pressure between a plurality of nested casing strings, comprising:

a housing having an outer surface and a hollow inner cavity and adapted for installation between adjacent nested casing strings, wherein the housing comprises a plurality of equally spaced centralizer blades disposed around the outer surface of the housing, and wherein a central bore is formed through a substantial portion of each centralizer blade;

a set of end connections disposed on opposite ends of the housing, which are adapted to join adjacent sections of one of the plurality of nested casing strings;

at least one valve disposed in the housing, which opens in response to a predetermined annular fluid pressure enabling fluid to pass from an outer annulus between adjacent nested casing strings disposed outside the housing to an annulus between different adjacent nested casing strings disposed inside the hollow inner cavity.

2. The apparatus according to claim 1, wherein at least one bore is formed through each centralizer blade, which opens to the central bore.

3. The apparatus according to claim 2, further comprising a rupture disc is secured into the at least one bore, and wherein the rupture disc is adapted to burst at a predetermined fluid pressure and thereby cause fluid to enter the central bore.

4. The apparatus according to claim 3, further comprising a filter assembly disposed within the central bore of each centralizer blade, said filter assembly comprising an inlet filter and a pair of seals disposed at opposite ends of the inlet filter, such that fluid entering the central bore is directed through the inlet filter.

5. The apparatus according to claim 4, wherein the at least one valve is formed within the central bore of each centralizer blade and is disposed axially adjacent to the filter assembly and in fluid communication therewith.

6. The apparatus according to claim 5, wherein the at least one valve comprises a gas lift valve coupled to at least one check valve.

7. The apparatus according to claim 6, wherein the gas lift valve comprises a nitrogen-charged bellows and a plunger, which is biased against a seat in the closed position by the bellows.

8. The apparatus according to claim 7, wherein the at least one check valve comprises a soft elastomeric seat, a hard stainless steel seat disposed beneath the soft elastomeric seat and a stainless steel check dart, which is initially sealed against the soft seat by a spring.

9. The apparatus according to claim 1, wherein a recess is milled into each centralizer blade proximate the central bore and in fluid communication therewith, and wherein the recess is disposed downstream of the at least one valve.

10. The apparatus according to claim 9, further comprising an outlet filter secured within the recess.

11. The apparatus according to claim 10, wherein a shoulder is formed within the recess and a plate is secured to the shoulder of the recess such that a fluid chamber is formed between the plate and the outlet filter secured within the recess, and the fluid chamber is in communication with the central bore.

12. The apparatus according to claim 11, further comprising a plurality of holes formed in the housing beneath the outlet filter, which allow the fluid to exit into the annulus disposed inside the hollow inner cavity of the housing.

13. The apparatus according to 12, further comprising an opening sleeve temporarily secured to the housing adjacent to the plurality of holes formed in the housing beneath the outlet filter, wherein the opening sleeve is disposed in the annulus inside the hollow inner cavity of the housing.

14. The apparatus according to claim 2, further comprising at least one inlet filter secured to each centralizer blade, such that fluid from the annulus disposed outside the housing passes through the inlet filter into the at least one bore.

15. The apparatus according to claim 1, wherein the plurality of equally spaced centralizer blades are integrally formed with the outer surface of the housing.

16. An apparatus for relieving trapped annular fluid pressure between a plurality of nested casing strings, comprising:

a housing having an outer surface and a hollow inner cavity and adapted for installation between adjacent nested casing strings;

at least one blade formed in the outer surface of the housing;

a set of end connections disposed on opposite ends of the housing, which are adapted to join adjacent sections of one of the plurality of nested casing strings, wherein the outer surface of the housing and inner hollow cavity of the housing are cylindrical and eccentric to one another;

at least one valve disposed in the housing, which opens in response to a predetermined annular fluid pressure enabling fluid to pass from an outer annulus between adjacent nested casing strings disposed outside the housing to an annulus between different adjacent nested casing strings disposed inside the hollow inner cavity.

17. The apparatus according to claim 16, wherein a central bore is formed through a substantial portion of the at least one blade.

18. The apparatus according to claim 17, wherein at least one bore is formed through the at least one blade, which opens to the central bore.

19. The apparatus according to claim 18, wherein a rupture disc is secured into the at least one bore, and wherein the rupture disc is adapted to burst at a predetermined fluid pressure and thereby cause fluid to enter the central bore.

20. The apparatus according to claim 19, further comprising a filter assembly disposed within the central bore of the at least one blade, said filter assembly comprising an inlet filter and a pair of seals disposed at opposite ends of the inlet filter, such that fluid entering the central bore is directed through the inlet filter.

21. The apparatus according to claim 20, wherein the at least one valve is formed within the central bore of the at least one blade and is disposed axially adjacent to the filter assembly and in fluid communication therewith.

22. The apparatus according to claim 21, wherein the at least one valve comprises a gas lift valve coupled to at least one check valve.

23. The apparatus according to claim 22, wherein the gas lift valve comprises a nitrogen-charged bellows and a plunger, which is biased against a seat in the closed position by the bellows.

24. The apparatus according to claim 23, wherein the at least one check valve comprises a soft elastomeric seat, a hard stainless steel seat disposed beneath the soft elastomeric seat and a stainless steel check dart, which is initially sealed against the soft seat by a spring.

25. The apparatus according to claim 17, wherein a recess is milled into the at least one blade proximate the central bore and in fluid communication therewith, and wherein the recess is disposed downstream of the at least one valve.

26. The apparatus according to claim 25, further comprising an outlet filter secured within the recess.

27. The apparatus according to claim 26, wherein a shoulder is formed within the recess and a plate is secured to the shoulder of the recess such that a fluid chamber is formed between the plate and the outlet filter secured within the recess, and the fluid chamber is in communication with the central bore.

28. The apparatus according to claim 27, further comprising a plurality of holes formed in the housing beneath the outlet filter, which allow the fluid to exit into the annulus disposed inside the hollow inner cavity of the housing.

29. The apparatus according to 28, further comprising an opening sleeve temporarily secured to the housing adjacent to the plurality of holes formed in the housing beneath the outlet filter, wherein the opening sleeve is disposed in the annulus inside the hollow inner cavity of the housing.

30. The apparatus according to claim 18, further comprising at least one inlet filter secured to the at least one blade, such that fluid from the annulus disposed outside the housing passes through the inlet filter into the at least one bore.

31. The apparatus according to claim 16, wherein the at least one blade is integrally formed with the outer surface of the housing.

* * * * *